US006648996B2

(12) United States Patent
Hasegawa

(10) Patent No.: US 6,648,996 B2
(45) Date of Patent: Nov. 18, 2003

(54) METHOD AND APPARATUS FOR PRODUCING A HELICAL SPRING

(75) Inventor: Keiji Hasegawa, Toyoake (JP)

(73) Assignee: Chuo Hatsujo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/976,158

(22) Filed: Oct. 15, 2001

(65) Prior Publication Data

US 2002/0046587 A1 Apr. 25, 2002

(30) Foreign Application Priority Data

Oct. 19, 2000 (JP) ..... 2000-319745
Jul. 11, 2001 (JP) ..... 2001-210929

(51) Int. Cl.[7] ..... C21D 7/00; C21D 8/00; B21F 35/00

(52) U.S. Cl. ..... 148/580; 148/908; 72/138; 266/116

(58) Field of Search ..... 148/580, 908; 72/138; 266/116

(56) References Cited

U.S. PATENT DOCUMENTS 3,906,766 A 9/1975 Sato
4,336,081 A * 6/1982 Hijikata et al. ..... 148/580
4,576,028 A * 3/1986 Morita ..... 72/143
5,839,312 A * 11/1998 Itaya ..... 72/142
6,151,942 A * 11/2000 Itaya ..... 72/137

FOREIGN PATENT DOCUMENTS

| | | | |
|---|---|---|---|
| DE | 43 09 012 | A1 | 9/1994 |
| EP | 1 093 870 | A2 | 4/2001 |
| JP | 6-106281 | A | 4/1994 |
| JP | 6-294631 | A | 10/1994 |
| JP | 7-248811 | A | 9/1995 |
| JP | A 8-10883 | | 1/1996 |
| JP | 9-141371 | A | 6/1997 |

* cited by examiner

*Primary Examiner*—Deborah Yee
(74) *Attorney, Agent, or Firm*—Oliff & Berridge, PLC

(57) ABSTRACT

The present invention is directed to a method for producing a helical spring which comprises the steps of providing a plurality of parameters for defining a desired configuration of a target helical spring, setting at least bending positions and twisting positions on the basis of the plurality of parameters, and bending and twisting the element wire at the positions set in response to every predetermined feeding amount of the element wire, to produce the target helical spring. The parameters includes number of coils, coil diameter and lead of the target helical spring. At least the bending positions may be adjusted in response to the cycle of alternating diameters between a local maximum diameter and a local minimum diameter of the target helical spring.

20 Claims, 13 Drawing Sheets

METHOD AND APPARATUS FOR PRODUCING A HELICAL SPRING

BACKGROUND OF THE INVENTION

1. Field of the Invention

The present invention relates to a method for producing a helical spring and an apparatus for producing the same, and more particularly to the method for producing the helical spring by cold working, and the apparatus for producing the same.

2. Description of the Related Arts

As for methods for producing helical springs, a method for producing the same by cold working and a method for producing the same by hot working are known heretofore. Various types of coiling machines are on the market for use as a machine for producing the helical springs by the cold working. In Japanese Patent Laid-open Publication Nos. 6-106281, 6-294631, 7-248811 and 9-141371, for example, the coiling machines are disclosed, and processes for controlling them are proposed. The basic structure of those machines is provided for bending and twisting an element wire while feeding the wire, to produce the helical springs, and it has been proposed to improve the machine accuracy by means of numerical control (NC). On the other hand, in accordance with recent progress of analytic technology, it is now possible to perform various simulations with respect to a certain spring-shaped model, and to design products on the basis of the result of the analysis. For example, it is possible to design a configuration of a spring having a certain characteristic, through FEM analysis.

In the case where the helical springs are manufactured by the coiling machines, however, mainly employed is a so-called try and error method for producing a helical spring temporarily and forming it in a certain configuration, with the dimensions of the temporarily formed spring being checked. In other words, although the coiling machines are driven according to the numerical control (NC), the data are input into the machines in dependence upon intuition or knack of operators. Therefore, measurements are made partially, so that overall configuration of the product can not be ensured, to cause such a problem that if its configuration is complex, the time for producing a prototype will be prolonged.

According to the machine disclosed in the Japanese Patent Laid-open Publication No. 7-248811 as described above, it is proposed to identify a part of the data to be corrected and confirm the data easily, in view of a prior automatic programming machine for use in a helical spring forming machine. In that publication, it is stated that the configuration of the helical spring produced by the prior machine was slightly different from the configuration of the designed spring in general, so that it was necessary for the operator to identify the part of the configuration to be corrected on the basis of the image obtained through the data shown on a display, whereby an error was likely caused. In order to solve the problem as described above, it is proposed that the configuration of the spring is shown on the display, then markers indicative of the part of the data to be corrected, and integrated number of coils (or turns) are displayed, and that the data are input by the operator, watching the configuration of the spring.

Also, improvements have been made with respect to the control of the coiling machines, as described in the above publications, but they are limited to the improvements from the view point of controlling the machines, so that they have not reached to a level of creating a working process for forming the objects to be worked into those of desired configurations, which can be done by an ordinary machinery working process. This is because the problem is resulted from specific issues on the helical spring as follows:

At the outset, when the helical spring is produced by the cold working, an elastic deformation is necessarily caused, to create a spring-back. Therefore, it is difficult to estimate a position of a working tool, and an appropriate distance to move the same, unlike a cutting process and so on. In addition, the amount of spring-back is varied in dependence upon hardness of the element wire, and the configuration of the helical spring. Especially, the manufactured compression helical spring is likely to cause a contact between the neighboring coils, so that it was very difficult to ensure a desired spring characteristic. In view of those matters, generally employed is a method for obtaining the NC data by checking the measurements of the actual products of prototypes.

Furthermore, the dimensions provided when designed and the dimensions formed by the coiling machine do not coincide with each other. For example, comparing with diameters of coils which are provided to indicate a desired configuration on a three-dimensional coordinate when the spring is designed, the diameters which are provided when the spring is formed are to be made larger, by a distance moved in the axial direction according to a lead. In addition, the feeding amount of the element wire (material) and the number of coils when worked (positions to be worked) do not coincide with each other, to cause a phase difference between the feeding amount of the element wire and bending positions or twisting positions. The number of coils as described above is used for identifying the position to be worked, from the coil end for example. Also, after the spring was formed by the coiling machine, generally a temper-treatment (low-temperature heat-treatment, hereinafter simply referred to as heat-treatment) is made to the spring, so as to cancel working stress applied thereto. Therefore, it is necessary to estimate a change in configuration of the spring, before working it.

From the foregoing reasons, it was impossible in the prior arts to accurately identify the actual position of the target to be formed, which should correspond to the position of the desired configuration on the coordinates. Therefore, the prototype was made by workers in dependence upon their intuition and knack, so that the spring was produced by a repetition of the try and error. As a result, the coiling machine capable of performing the numerical control could not be operated to fully use its inherent function, so that its operation was not far beyond a range of manual operation.

SUMMARY OF THE INVENTION

Accordingly, it is an object of the present invention to provide a method for producing a helical spring by cold working, with an element wire bent and twisted while the wire being fed, wherein a target helical spring of a desired configuration set in advance can be produced automatically and accurately.

It is another object of the present invention to provide a method for producing a helical spring by cold working, with an element wire bent and twisted while the wire being fed, wherein a target helical spring of a deformed configuration set in advance can be produced automatically and accurately.

And, it is a further object of the present invention to provide an apparatus for producing a target helical spring of a desired configuration including a deformed configuration set in advance, automatically and accurately.

In accomplishing the above and other objects, a method for producing a helical spring comprises the steps of providing a plurality of parameters for defining a desired configuration of a target helical spring, setting at least bending positions and twisting positions on the basis of the plurality of parameters, and bending and twisting the element wire at the positions set in response to every predetermined feeding amount of the element wire, to produce the target helical spring. In this method, preferably, the parameters includes number of coils, coil diameter and lead of the target helical spring.

The method as described above may further comprise the steps of applying a predetermined after-treatment to the helical spring produced by bending and twisting the element wire, and correcting the bending positions and twisting positions set on the basis of the plurality of parameters, in accordance with the configuration of the helical spring with the after-treatment applied thereto.

The method as described above may further comprise the step of adjusting at least the bending positions in response to the cycle of alternating diameters between a local maximum diameter and a local minimum diameter of the target helical spring.

According to the present invention, an apparatus for producing a helical spring by cold working to bend and twist an element wire while feeding the wire includes a parameter setting device which is adapted to provide a plurality of parameters for defining a configuration of a target helical spring, a data converting device which is adapted to convert the plurality of parameters provided by the parameter setting device into at least bending positions and twisting positions, a working conditions setting device which sets at least the bending positions and twisting positions in response to the result converted by the data converting device, a feeding device for feeding the element wire, a bending device for bending the element wire fed by the feeding device, and a twisting device for twisting the element wire fed by the feeding device. And a driving device is provided for driving the feeding device, the bending device and the twisting device, to place the element wire at the positions set in response to every predetermined feeding amount of the element wire, on the basis of the bending positions and twisting positions set by the working conditions setting device, then bend and twist the element wire, to produce the target helical spring.

The apparatus as described above may further include an adjusting device for adjusting at least the bending positions in response to the cycle of alternating diameters between a local maximum diameter and a local minimum diameter of the target helical spring, and the working conditions setting device is adapted to set at least the bending positions and twisting positions in response to the result converted by the data converting device and the result adjusted by the adjusting device.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
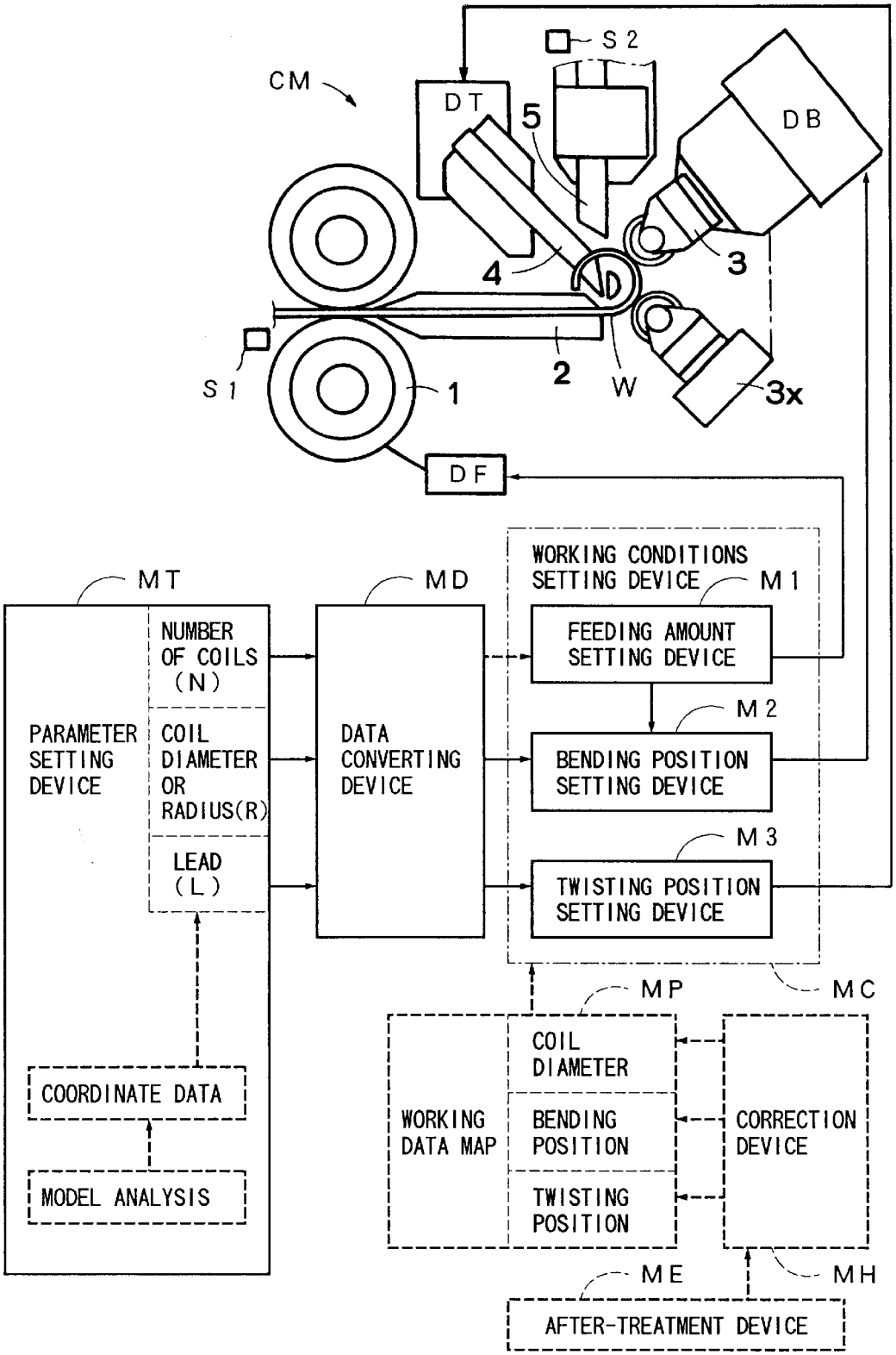
FIG. 1 is a block diagram showing an apparatus for producing a helical spring according to an embodiment of the present invention.

Referring to FIG. 1, there is schematically illustrated an apparatus for producing a helical spring according to an embodiment of the present invention, which includes a conventional coiling machine CM. That is, the fundamental structure of the coiling machine CM is the same as the one distributed on the market. As shown in the upper section in FIG. 1, it is so constituted that an element wire W of the helical spring is fed by a feed roller 1, which serves as an element wire feeding device according to the present invention, through a wire guide 2. The feed roller 1 is driven by a motor DF, which serves as a driving device according to the present invention.

And, a couple of coiling pins 3 and 3*x*, which serve as a bending device according to the present invention, are disposed to be moved toward and away from the center of each coil of the target helical spring by means of an oil pressure servo cylinder DB (hereinafter, simply referred to as a cylinder DB). The coiling pin 3*x* is adapted to move slightly in response to movement of the coiling pin 3 so as to prevent the wire W from being offset to a cutting axis, while it may be placed at a fixed position. By means of the coiling pins 3 and 3*x*, therefore, an appropriate coiling operation can be made, while the operation of only coiling pin 3 will be explained hereinafter. Furthermore, a pitch tool 4, which serves as a twisting device according to the present invention, is disposed to be moved back and forth by means of an oil pressure servo cylinder DT (hereinafter, simply referred to as a cylinder DT). Likewise, a cutter 5 is disposed to be moved back and forth. Each driving device as described above may not be limited to the motor or cylinder employed in the present embodiment, but an electric driving device, oil pressure driving device and the like may be employed.

In response to rotation of the feed roller 1, therefore, the wire W is guided by the wire guide 2 and delivered rightward in FIG. 1. Then, the wire W is bent by the coiling pin 3 to provide a desired diameter. During this process, each pitch between neighboring coils is controlled by the pitch tool 4 to be of a predetermined value. When the wire W is coiled to provide a predetermined number of coils, it is cut by the cutter 5. Together with these processes and operation orders, the coil diameter and so on are stored in a memory of a controller CT in advance, and the feed roller 1, coiling pin 3, pitch tool 4 and cutter 5 are driven by each driving device, according to a program as shown in a flow chart as explained later.

An apparatus for controlling and driving the coiling machine CM as described above is constituted as follows. That is, the apparatus includes a parameter setting device MT which provides a plurality of parameters for defining a desired configuration of a target helical spring (not shown), a data converting device MD which converts the plurality of parameters provided by the parameter setting device MT into at least bending positions and twisting positions, and a working conditions setting device MC which sets the bending positions and twisting positions in response to the result converted by the data converting device MD. Furthermore, a driving device, which includes the motor DF and cylinders DB, DT, is provided for driving the feed roller 1, coiling pin 3 and pitch tool 4, to place the element wire W at the positions set in response to every predetermined feeding amount of the element wire W, on the basis of the bending positions and twisting positions set by the working conditions setting device MC. According to the driving device, therefore, the feed roller 1, coiling pin 3 and pitch tool 4 are driven to bend and twist the element wire W, thereby to produce the target helical spring (not shown).

The working conditions setting device MC includes a feeding amount setting device M1 which is provided for setting the feeding amount of the element wire fed from a predetermined reference position, a bending position setting device M2 which is provided for setting the bending position in response to the feeding amount of the element wire set by the feeding amount setting device M1, and a twisting position setting device M3 which is provided for setting the twisting position in response to the feeding amount of the element wire set by the feeding amount setting device M1. And, it is so constituted that each driving device (DF, DB, DT) is driven in response to the amount set by each setting device (M1, M2, M3).

According to the parameter setting device MT, the parameters are set to include number of coils, coil diameter, and lead of the target helical spring. At the outset, the target helical spring is designed on the basis of the result of a model analysis, to obtain its data on the three-dimensional polar coordinates, which are set as the parameters. As for the data provided when the target helical spring is designed, there are provided a wire diameter (d), number of coils (N), a coil diameter (D) (or, radius (R)), a lead (L), load, space between neighboring coils and so on. Among these data, configuration data (radius (R) and lead (L)) are converted by the data converting device MD into product dimensional data (coil diameter (D) and pitch (P)), which are provided when the spring is formed by the coiling machine CM.

Figure 6:
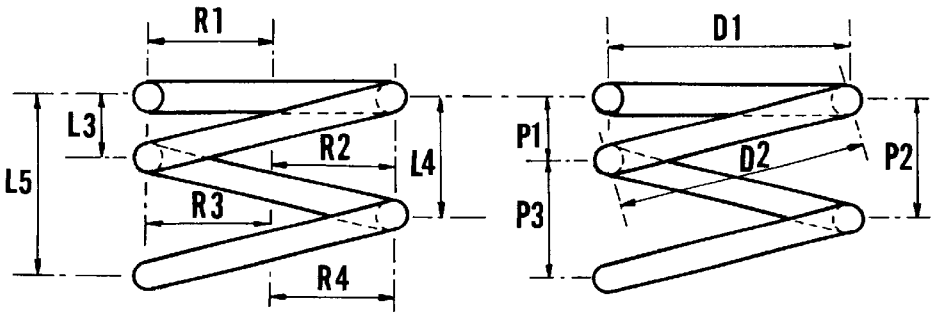
FIG. 6 is a diagram showing a relationship when transforming designed configuration into product dimentional data according to an embodiment of the present invention.

The configuration data provided when the spring is designed and the product dimensional data provided when the spring is formed correspond to each other as shown in FIG. 6, and the conversion between them can be made automatically by the data converting device MD. As for the coordinate data when the spring is designed, the total number of coils (N) is divided by an optional unit number of coils (preferably, equal to or less than 0.1 coils), and the radiuses of the coils (R1, R2, R3, R4 - - - ) are set, along the leads (L3, L4, L5 - - - ), as shown at the left side in FIG. 6. On the other hand, as for the product dimensional data, the coil diameters (D1, D2 - - - ) are set along the pitches (P1, P2, P3 - - - ) for the above-described unit number of coils, as shown at the right side in FIG. 6. The configuration data provided when the spring is designed are converted into the product dimensional data by the data converting device MD. With the data adjusted by the dimension of diameter as described above, it is easy to produce even a curved helical spring having a central axis thereof different from a reference axis. In order to identify a position to be worked, the number of coils from a reference point (e.g., a coil end to be coiled) may be used.

As indicated by broken lines in FIG. 1, therefore, a working data map MP is provided for setting the bending positions and the twisting positions in response to the diameters of the helical spring (i.e., coil diameters) which are converted into the product dimensional data. And, on the basis of the working data map MP, the bending positions and the twisting positions are set by the working conditions setting device MC, so that the working conditions can be easily provided, as will be described later in detail. Furthermore, an after-treatment device ME may be provided for applying a predetermined after-treatment to the helical spring, after the bending process and twisting process to it were finished. As for the after-treatment, may be employed the aforementioned heat-treatment and a so-called "setting", which applies a predetermined load to the helical spring produced by bending and twisting the element wire. A correction device MH may be provided for correcting the coil diameter, the bending positions and the twisting positions, in accordance with the configuration of the helical spring with the after-treatment applied thereto, as will be described later in detail.

Figure 2:
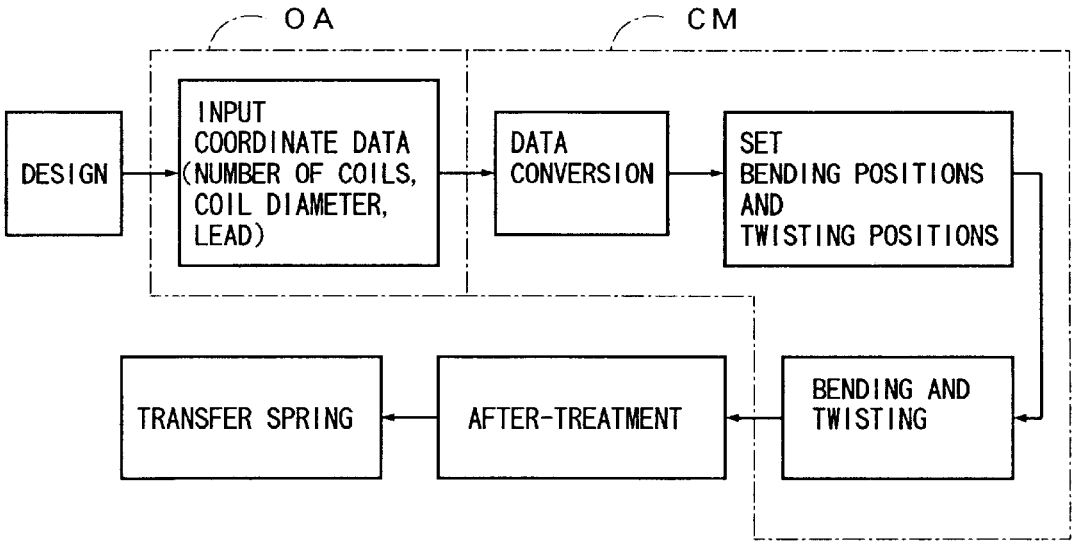
FIG. 2 is a block diagram showing processes in a method for producing a helical spring according to an embodiment of the present invention.

Next, will be explained about the method for producing the helical spring by means of the coiling machine CM as constituted above, according to the processes from the designing process to transferring process, with reference to FIG. 2. After the target helical spring was designed, and the three-dimensional polar coordinate data were obtained, these data are input as parameters into a controller (described later with reference to FIG. 3) of the coiling machine CM by a peripheral device OA such as a key board, and they are converted into the product dimensional data (coil diameter (D) and pitch (P)) provided when the spring is formed, as described before. Accordingly, the bending positions and the twisting positions are set in response to the predetermined feeding amount, to form the working data map MP. Then, on the basis of these bending positions and twisting positions, the bending and twisting processes are made to form the helical spring (not shown). According to the present embodiment, the temper-treatment (heat-treatment) is applied to the helical spring as the after-treatment, and then transferred outside.

In addition to that, the setting process for applying the predetermined load to the spring may be made. That is, it is usual to make the setting process by applying the predetermined load to the spring after the temper-treatment, as the after-treatment to be made after the bending and twisting processes were finished, whereby the coil diameters and pitches for the coiling operation are varied. Therefore, the change of spring after setting it may be estimated, to correct the data for the bending and twisting processes before the coiling operation.

Figure 3:
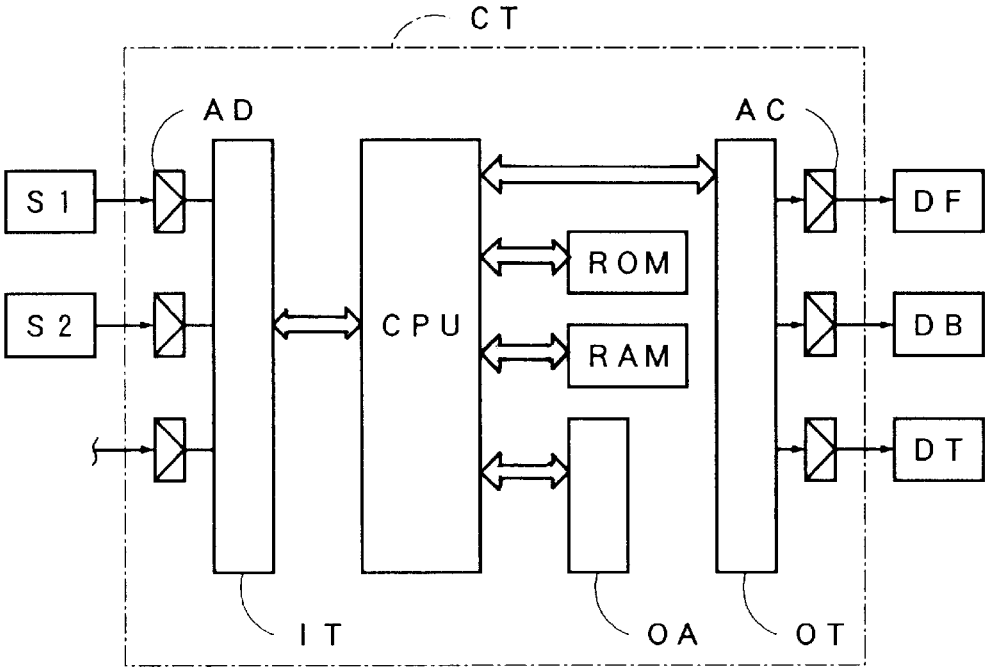
FIG. 3 is a block diagram showing components of a coiling machine according to an embodiment of the present invention.

FIG. 3 illustrates a part of the controller CT that is used for the coiling machine CM, and provided with a processing unit CPU, memories ROM and RAM, input interface IT, output interface OT, and peripheral device OA including the key board, display, printer so on. According to the present embodiment, a sensor S1 for detecting the wire W as shown in FIG. 1, a sensor S2 for detecting operation of the cutter 5, encoders (not shown) for monitoring the moving amount and positions of the coiling pin 3, pitch tool 4 and the like are connected to the input interface IT, whereas the motor DF and cylinders DB, DT are connected to the output interface OT. Therefore, the output signals of the sensors S1, S2 and so on are fed into the processing unit CPU through the A/D converter AD via the input interface IT, whereas the signals for driving the motor DF and cylinders DB, DT are output through driving circuits AC. The parameter setting device MT, data converting device MD, working conditions setting device MC and the working data map MP are constituted in the controller CT. The memory ROM is adapted to memorize a program for use in various processes including those performed according to the flowcharts as shown in FIGS. 4 and 5, the processing unit CPU is adapted to execute the program while being actuated, and the memory RAM is adapted to temporarily memorize variable data to execute the program.

Figure 4:
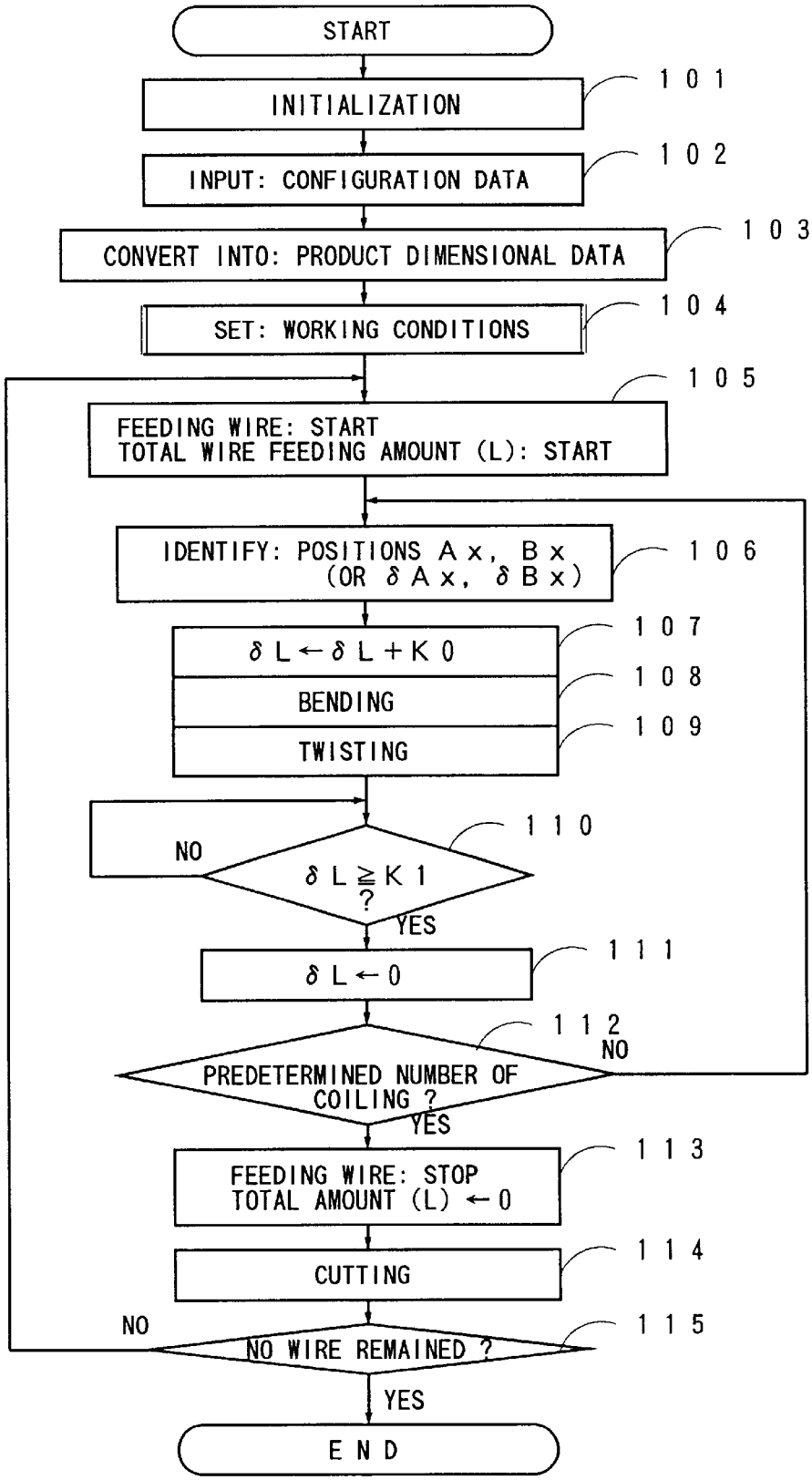
FIG. 4 is a flow chart showing a coiling operation according to an embodiment of the present invention.
Figure 5:
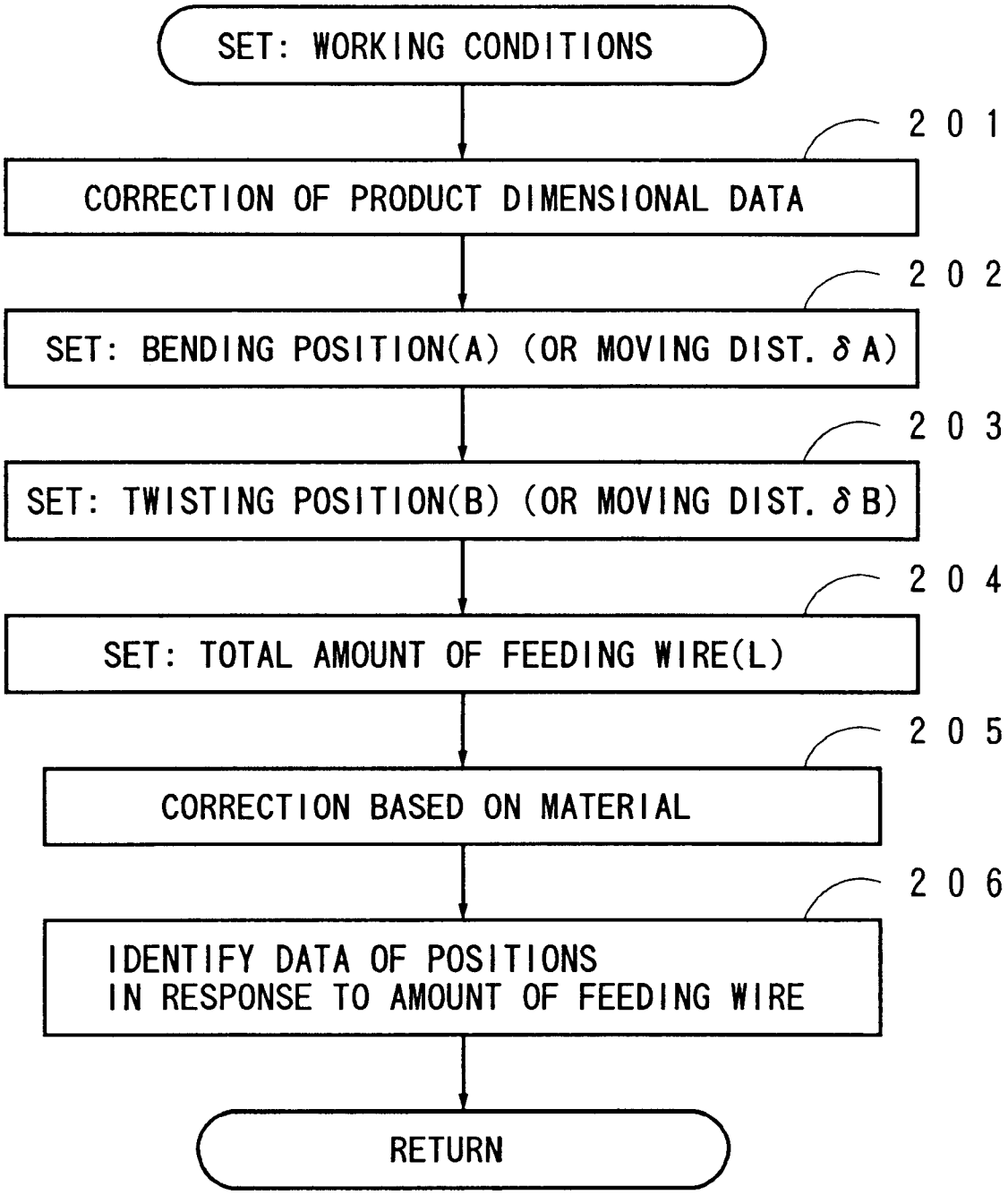
FIG. 5 is a flow chart showing a process for setting working conditions according to an embodiment of the present invention.

The coiling machine CM as shown in FIG. 1 is controlled according to the flowchart as shown in FIG. 4, to perform the coiling operation, as will be described hereinafter. At the outset, initialization is made to clear various data stored in the memory RAM, at Step 101. Then, the designed configuration data are input by the key board (not shown) of the peripheral device OA at Step 102. That is, the wire diameter (d), number of coils (N), coil diameter (D) (or, radius (R)), lead (L) and the like of the target helical spring which was designed on the basis of the result of the model analysis, are input into the processing unit CPU. And, at Step 103, the configuration data (radius (R) and lead (L)) are converted into the product dimensional data (coil diameter (D) and pitch (P)) which are used when the spring is formed by the coiling machine CM, as shown in FIG. 6. In this respect, it should be noted that the radius (R) is used for identifying the configuration data as shown at the left side in FIG. 6, while the diameter (D) is used for identifying the product dimensional data as shown at the right side in FIG. 6, and that if these data are confused when forming the spring, an error will be caused.

Figure 12:
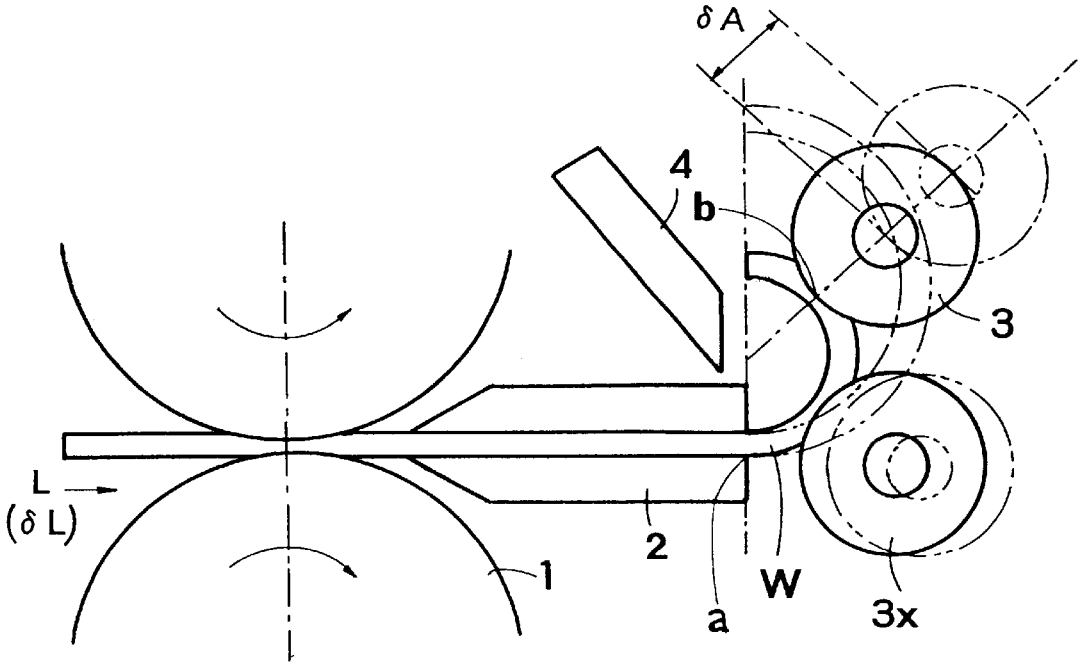
FIG. 12 is a plan view showing a relationship between a feeding amount of an element wire and a moving amount of a coiling pin when the wire is bent, according to an embodiment of the present invention.
Figure 13:
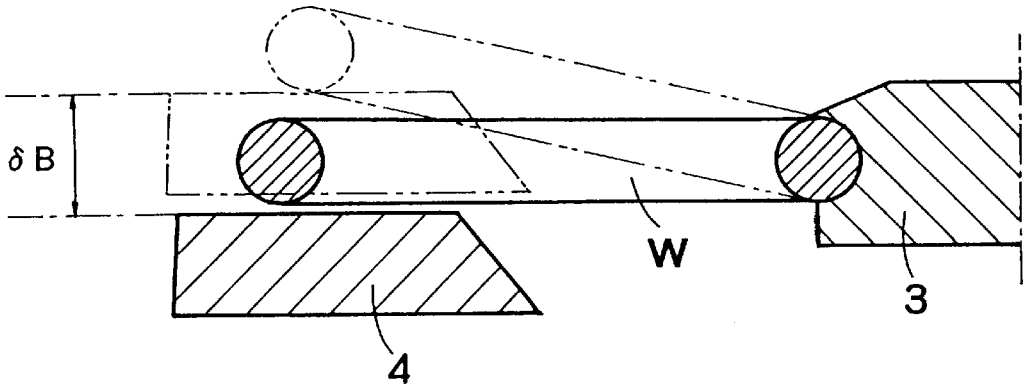
FIG. 13 is a sectional view showing a moving amount of a pitch tool when the wire is twisted, according to an embodiment of the present invention.

Next, the program proceeds to Step 104, where the working conditions such as a total wire feeding amount (L) (and, wire feeding amount (δL)) of the element wire, bending position (A) (or, moving amount (δA)) and twisting position (B) (or, moving amount (δB)) are set, as will be described later with reference to FIG. 5. In this respect, the relationship between the total wire feeding amount (L) (and, wire feeding amount (δL)) and the moving amount (δA) of the coiling pin 3 in the bending process is shown in FIG. 12, and the relationship between the total wire feeding amount (L) (and, wire feeding amount (δL)) and the moving amount (δB) of the pitch tool 4 in the twisting process is shown in FIG. 13. Then, the program proceeds to Step 105 where the feeding of the element wire begins, so that the element wire is fed from a bundle of the rolled wire by the feed roller 1, and the working process to the wire of the total wire feeding amount (L) is initiated from the coil end of the element wire to be coiled. The total wire feeding amount (L) is indicated by the number of coils from the reference position of the coil end of the element wire (e.g., 6 coils or turns), and then divided into a plurality of wire feeding amount (δL) in accordance with the data converting process. In the present embodiment, however, these are simply called as the wire feeding amount, except for the specific case needed to distinguish them.

On the basis of the total wire feeding amount (L), the bending position (Ax) (or, moving amount (δAx)) and the twisting position (Bx) (or, moving amount (δBx)) for the total wire feeding amount (Lx) or wire feeding amount (δLx) are identified at Step 106, according to the working conditions set at Step 104. Then, the program proceed to Step 107, where a predetermined amount (KO) is added to the wire feeding amount (δL) (the initial value of δL is 0) to provide the wire feeding amount (δL). Then, the bending process and twisting process are made at Steps 108 and 109, respectively, synchronizing with the feeding operation of the wire by the wire feeding amount (δL), whereby the coiling pin 3 and pitch tool 4 are driven so that the bending position (Ax) (or, moving amount (δAx)) and the twisting position (Bx) (or, moving amount (δBx)) are provided when the total wire feeding amount or the wire feeding amount has reached to (Lx) or (δLx).

With the consecutive working process as described above performed sequentially, the bending process and twisting process will be made until it will be determined at Step 110 that the wire feeding amount (δL) is equal to or greater than a predetermined amount (K1) (e.g., 5/100 coils). If it is determined at Step 110 that the wire feeding operation of the predetermined amount (K1) and the bending and twisting processes synchronized therewith are finished, the program proceeds to Step 111 where the wire feeding amount (δL) is cleared to be zero (0), and further proceeds to Step 112 where it is determined if the coiling operation of the predetermined number of coils (e.g., 6 coils) is finished (i.e., determined if it is L=6). If it is not finished, the program returns to Step 106, and the bending and twisting processes will be made until the coiling operation of the predetermined number of coils is finished.

If it is determined at Step 112 that the coiling operation for the predetermined number of coils is finished, the program proceeds to Step 113 where the wire feeding operation is terminated, and the total wire feeding amount (L) is cleared to be zero (0). Then, the wire is cut by the cutter 5 (shown in FIG. 1) at Step 114, so that the coiling operation for a single helical spring is finished. At Step 115, therefore, it is determined whether the element wire is remained or not. If the element wire is remained, the program returns to Step 105 where next coiling operation will start. Thus, a plurality of helical springs are consecutively produced automatically, and if it is determined at Step 115 that the element wire is not remained, the program ends, so that all of the operations including the feeding operation of the element wire are terminated.

Figure 9:
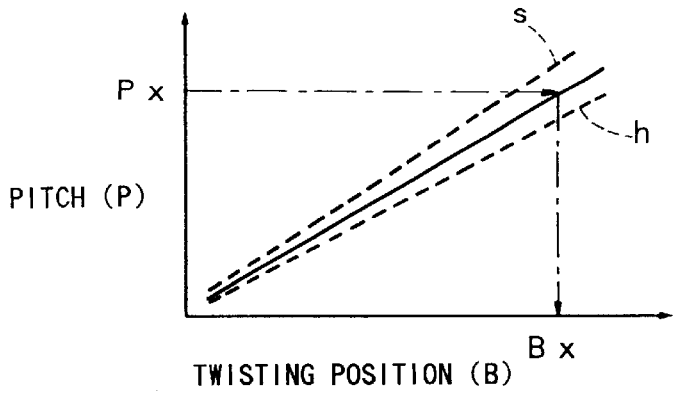
FIG. 9 is a diagram for use as an map for setting a twisting position in response to a pitch according to an embodiment of the present invention.
Figure 10:
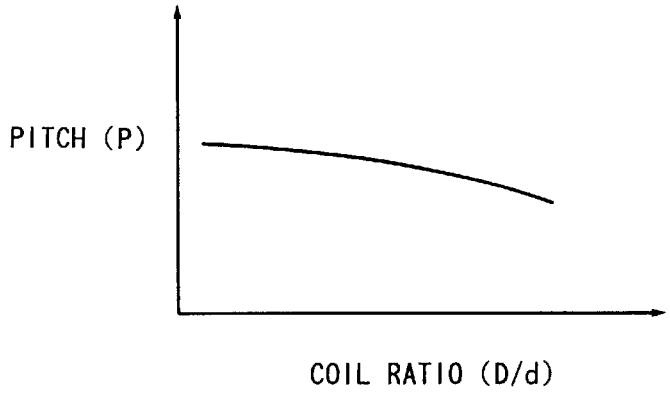
FIG. 10 is a diagram showing a pitch varied in response to a coil ratio according to an embodiment of the present invention.
Figure 11:
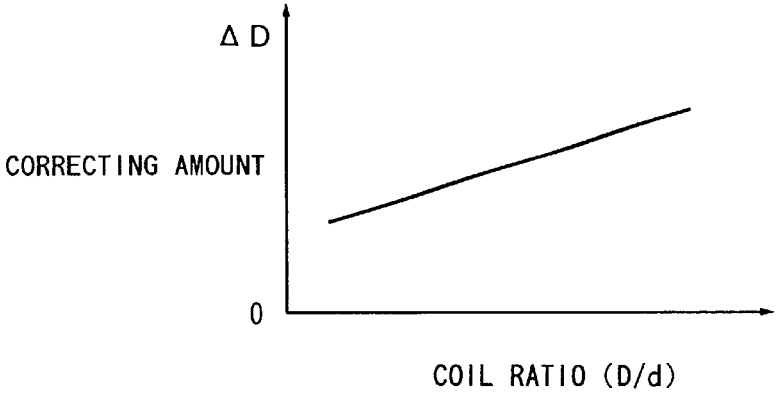
FIG. 11 is a diagram for use as an map for setting a correcting amount to the coil diameter in response to the coil ratio according to an embodiment of the present invention.

The working conditions set at Step 104 are provided as shown in FIG. 5, and the bending position (A) (or, moving amount (δA)) and the twisting position (B) (or, moving amount (δB)) are set as shown in FIGS. 7–10, and a correcting process thereto is made, to provide the data indicative of positions in accordance with the total wire feeding amount (L) (or, the wire feeding amount (δL)). When the after-treatment (e.g., temper-treatment) is made after the coiling operation at Step 201, the coil diameter will be varied to cause a so-called "shrinkage". In this case, the varied amount is not constant. For example, the amount of shrinkage caused by the temper-treatment is varied in response to the coil diameter (D) and the wire diameter (d). According to the present embodiment, therefore, a correcting amount (ΔD) to the coil diameter (D) is set in response to a coil ratio D/d (the ratio of the coil diameter (D) to the wire diameter (d)), as shown in FIG. 11, and the coil diameter (D) is corrected by adding thereto the correcting amount (ΔD) at Step 201, thereby to provide a corrected value (D+ΔD) as an estimated data before tempering, which is provided for setting the bending position (A) (or, moving amount (δA)) at the next Step 202. Or, the deformation by the setting as described before may be estimated at step 201, to obtain an estimated data before setting.

Figure 7:
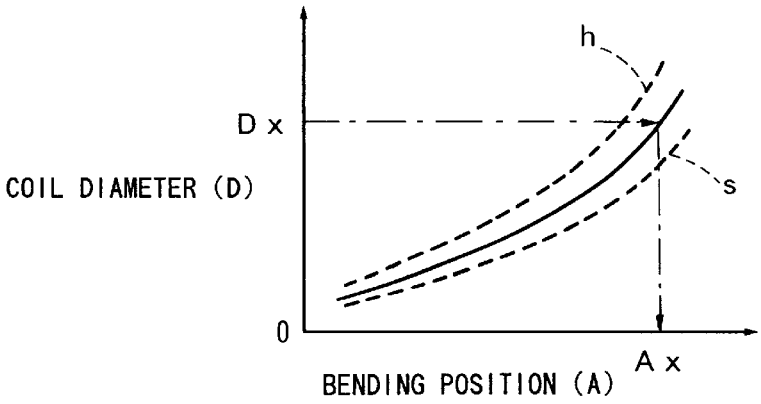
FIG. 7 is a diagram for use as a map for setting a bending position in response to a coil diameter according to an embodiment of the present invention.
Figure 8:
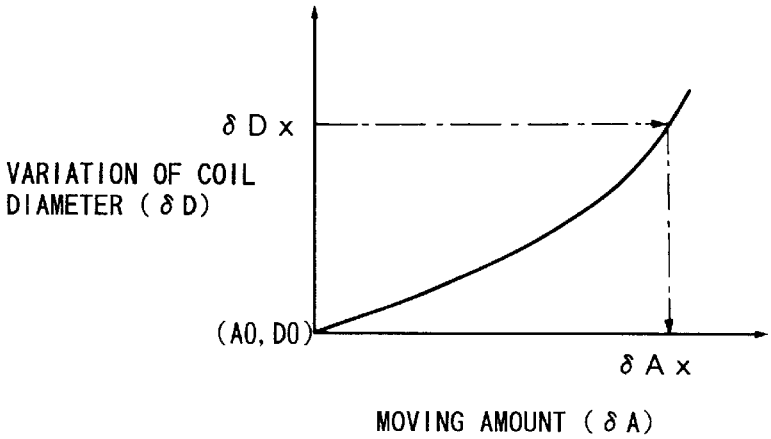
FIG. 8 is a diagram for use as a map for setting a moving amount in response to a variation of a coil diameter according to an embodiment of the present invention.

Next, at Step 202, the bending position (A) (i.e., the position of the coiling pin 3) is set in response to the product dimensional data converted at Step 103, in accordance with the map as shown in FIG. 7, which shows the relationship between the coil diameter (D) and the bending position (A). As indicated by arrows of one-dotted chain line in FIG. 7, therefore, a certain bending position (Ax) is set for a certain coil diameter (Dx). The characteristic as shown in FIG. 7 is varied in dependence upon the wire diameter (d). In accordance with variation of the wire diameter (d), therefore, it is necessary to provide a plurality of maps, one of which can be properly selected in accordance with the wire diameter (d). In FIG. 7, a broken line (h) indicates the characteristic for the wire of relatively hard material, while a broken line (s) indicates the characteristic for the wire of relatively soft material. Thus, the characteristic as shown in FIG. 7 is varied in dependence upon the material of the element wire. Therefore, a plurality of maps may be provided in accordance with the material of the element wire. According to the present embodiment, however, an average characteristic is provided as a standard characteristic, and a correction thereto is made in response to hardness of the material of the element wire, separately, at Step 205. According to the map as shown in FIG. 7, the data will become large. In order to avoid the large data, therefore, may be employed, a map as shown in FIG. 8, wherein a reference position is provided at a position having the coil diameter (D0) of the end coil to be coiled, and the bending position (A0) corresponding thereto, and wherein the relationship between a variation (δD) of the coil diameter from the reference position and the moving amount (δA) of the bending process (i.e., the moving amount of the coiling pin 3) is indicated.

Then, at Step 203, the twisting position (B) (i.e., the position of the pitch tool 4) is set in accordance with the map as shown in FIG. 9, which shows the relationship between the pitch (P) and the twisting position (B). As indicated by arrows of one-dotted chain line in FIG. 9, therefore, a certain twisting position (Bx) is set for a certain pitch (Px) of the spring. The characteristic as shown in FIG. 9 is varied in dependence upon the wire diameter (d) and hardness of the material of the element wire. As shown in FIG. 10, for example, the pitch (P) is varied in dependence upon the coil ratio (D/d). Therefore, in the case where the coil diameter varies largely in a single spring, the correcting process may be made, and a plurality of maps may be provided. In FIG. 9, a broken line (h) indicates the characteristic for the wire of relatively hard material, while a broken line (s) indicates the characteristic for the wire of relatively soft material. Thus, the characteristic as shown in FIG. 9 is varied in dependence upon the material of the element wire. Therefore, a plurality of maps may be provided in accordance with the material of the element wire. According to the present embodiment, however, an average characteristic is provided as a standard characteristic, and a correction thereto is made in response to the hardness of the material of the element wire, separately, at Step 205.

Furthermore, when the temper-treatment is made as described before, the coil diameter will be changed, so that the number of coils of the product will be varied. At Step 204, therefore, the variation of the number of coils is estimated on the basis of the variation of the diameter caused by the temper-treatment, to set the total wire feeding amount (L) (indicated by the number of coils) for the coiling operation which is made before the temper-treatment. According to the present embodiment, the total wire feeding amount after the temper-treatment (i.e., the number of coils of the product) is multiplied by a correcting value K4, which is stored in a data base, or which can be calculated according to a correlation function. For example, in the case where the product is made in such a condition that it is formed to provide 6 coils (2000 mm) after the temper-treatment was made (i.e., when finished), and that it is formed to provide 5.8 coils before the temper-treatment is made, then the number of coils of "6" is employed as the product dimensional data, and the total wire feeding amount (L) for the coiling operation is multiplied by the correcting value K4 to provide 6 coils after the temper-treatment is made.

Next, at Step 205, the bending position (A) and the twisting position (B) are corrected in response to the hardness of material of the element wire. According to the present embodiment, the bending position (A) and the twisting position (B) are multiplied by correcting values K2 and K3, respectively, in accordance with the material of the element wire. The correcting value K2 to the bending position (A) can be estimated by the tensile strength of the material (having a relationship of inverse proportion to its hardness). Therefore, it may be so constituted that the tensile strength of the material is input when the material is changed, and that the correcting value K2 will be selected automatically, when a specific material is input. And, the correcting value K3 to the twisting position (B) may be set by estimating the result of the last adjustment of height of the spring in its free condition, which will be made after setting will be made at a later stage. This correcting process may be made in advance, together with the correcting process made at Step 201, or may be made prior to or after all of the processes are made together with the process at Step 201.

Then, at Step 206, the bending position (A) (or, moving amount (δA)) and the twisting position (B) (or, moving amount (δB)) are identified (or, allocated) in accordance with the total wire feeding amount (L) (or, the wire feeding amount (δL)). In this case, a phase difference is to be considered. For example, when the total wire feeding amount (L) is Lx (e.g., 1.0 coils), the bending position (Ax) is allocated for the coil diameter between 1.1 coils and 1.6 coils, and the twisting position (Bx) is allocated for the pitch between 0.7 coils to 1.7 coils. In other words, when the total wire feeding amount (L) becomes 1.0 coils, the coil diameter has become 1.1 coils, which is considered to be the position where the forming the coil diameter for the coil of 1.1 coils or more will start. On the other hand, the pitch is provided by the twisting process of the element wire as described above. This is because when the total wire feeding amount (L) becomes 1.0 coils, the position to be set by the twisting process is considered to be a position with 0.5 coils advanced to the position where the twisting is actually caused, and corresponds to the position of 0.7 coils from the end coil of the spring to be coiled. As described above, the bending position (A) (or, moving amount (δA)) and the twisting position (B) (or, moving amount (δB)) are identified in accordance with the total wire feeding amount (L) (or, the wire feeding amount (δL)) of the element wire, and the working conditions are provided, in view of the phase difference, according to the present embodiment.

Figure 14:
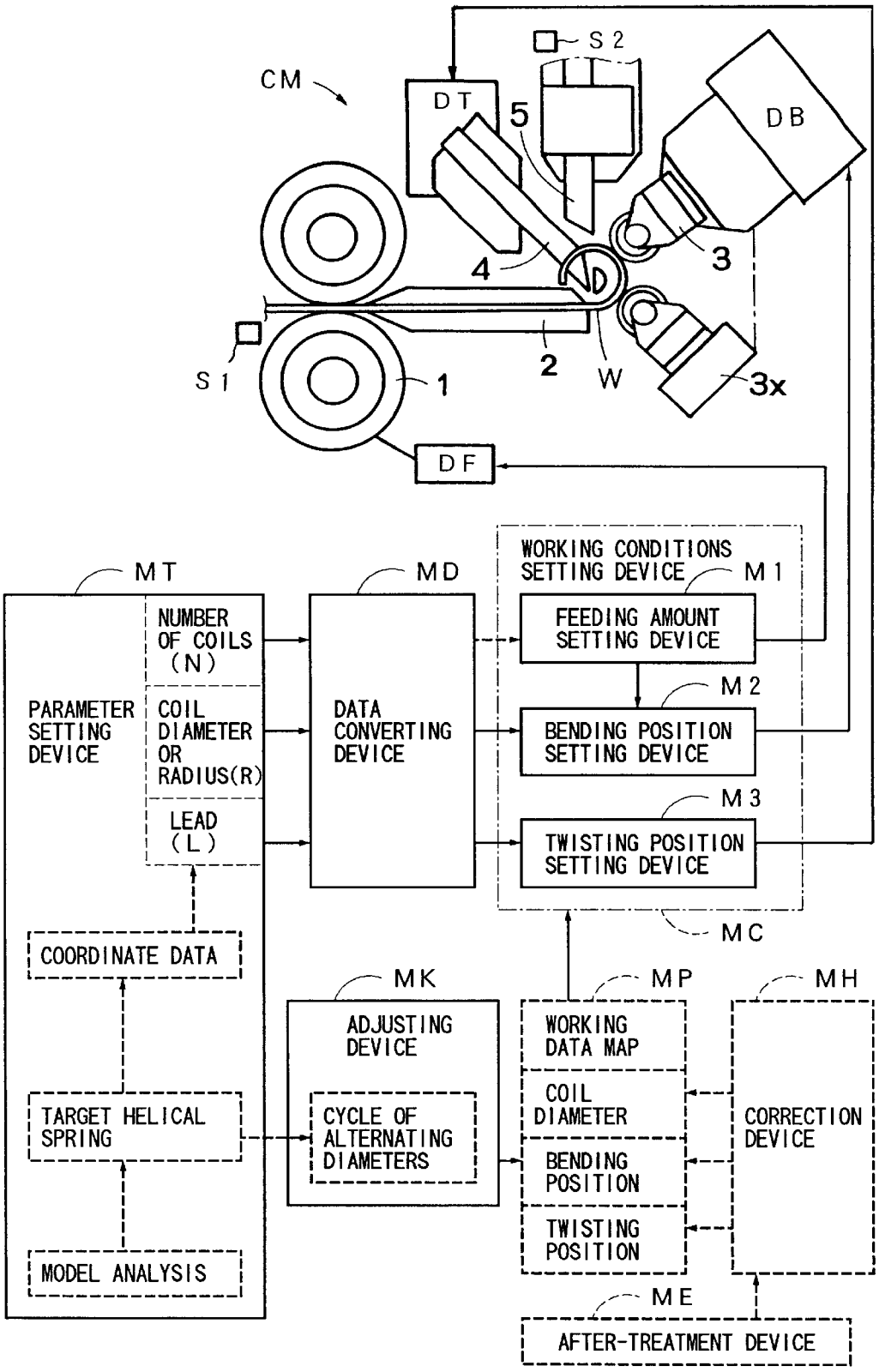
FIG. 14 is a block diagram showing an apparatus for producing a helical spring according to another embodiment of the present invention.
Figure 15:
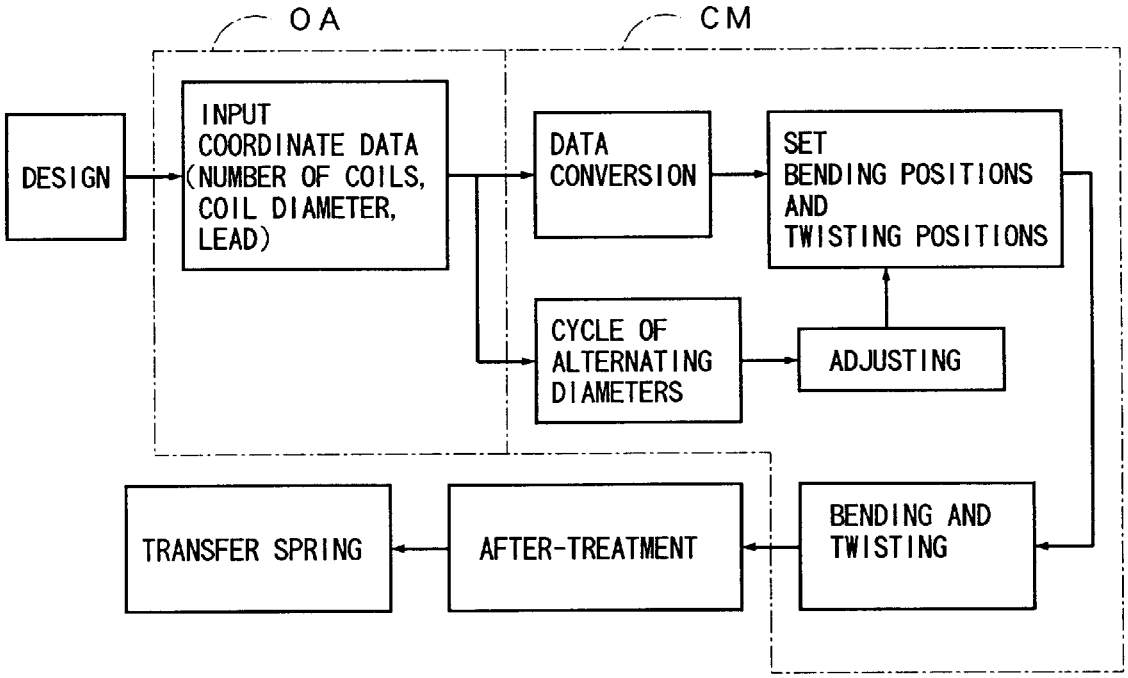
FIG. 15 is a block diagram showing processes in a method for producing a helical spring according to another embodiment of the present invention.

Next, will be explained about another embodiment of the present invention with reference to FIGS. 14–25. FIG. 14 illustrates an apparatus for producing a helical spring according to another embodiment of the present invention, which includes the coiling machine CM that is the same as the one disclosed in FIG. 1. And, the apparatus for controlling and driving the coiling machine CM includes the parameter setting device MT which provides a plurality of parameters for defining a desired configuration of a target helical spring, including a deformed configuration as disclosed in FIG. 19 and FIG. 20, for example, and the data converting device MD which converts the plurality of parameters provided by the parameter setting device MT into at least bending positions and twisting positions. The apparatus further includes an adjusting device MK which adjusts at least the bending positions in response to the cycle of alternating diameters between a local maximum diameter and a local minimum diameter of the target helical spring. In this respect, the cycle of alternating diameters is meant by the cycle of varying coil diameters, and it is indicated by the number of coils between the local maximum diameter and the local minimum diameter of the helical spring.

The apparatus further includes the working conditions setting device MC which is adapted to set at least the bending positions and twisting positions in response to the result converted by the data converting device MD and the result adjusted by the adjusting device MK. Accordingly, by means of the driving device (motor DF and cylinders DB, DT), the feed roller 1, coiling pin 3 and pitch tool 4 are driven to bend and twist the element wire W, thereby to produce a helical spring corresponding to the target helical spring, e.g., a helical spring S1 as shown in FIGS. 19 and 20.

The working conditions setting device MC includes the feeding amount setting device M1 which is provided for setting the feeding amount of the element wire W fed from the predetermined reference position, the bending position setting device M2 which is provided for setting the bending position in response to the feeding amount of the element wire set by the feeding amount setting device M1, and the twisting position setting device M3 which is provided for setting the twisting position in response to the feeding amount of the element wire set by the feeding amount setting device M1. According to the present embodiment, at least the bending position setting device M2 is adjusted by the adjusting means MK as shown in FIG. 14, and each driving device (DF, DB, DT) is driven in response to the amount set by each setting device (M1, M2, M3). The rest of the same components as those disclosed in FIG. 1 function in substantially the same manner, so that the explanation is omitted herein.

Figure 19:
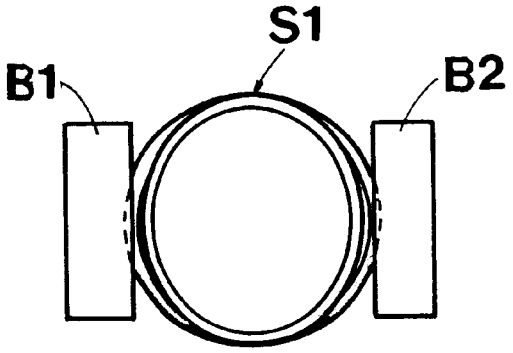
FIG. 19 is a plan view of a helical spring produced according to another embodiment of the present invention.
Figure 20:
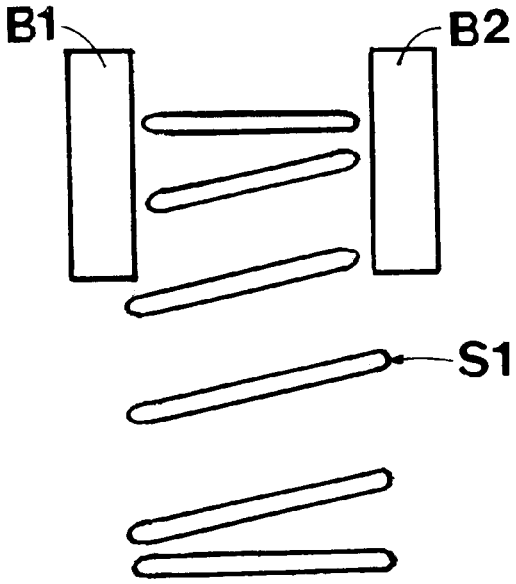
FIG. 20 is a front view of a helical spring produced according to another embodiment of the present invention.

According to the present embodiment as shown in FIG. 14, it is easy to produce even the deformed helical spring as shown in FIG. 19 and FIG. 20. In practice, when the target helical spring is the deformed helical spring S1 as shown in FIG. 19 and FIG. 20, at least the bending positions are adjusted by the adjusting device MK in response to the cycle of alternating diameters between a local maximum diameter and a local minimum diameter of the target helical spring, as will be described later in detail.

Next, will be explained about the method for producing the helical spring by means of the coiling machine CM as constituted in FIG. 14 (and FIG. 1), according to the processes from the designing process to transferring process, with reference to FIG. 15 and FIGS. 3–6. After the target helical spring was designed, and the three-dimensional polar coordinate data were obtained, these data are input as parameters into the controller CT as shown in FIG. 3 by the peripheral device OA such as the key board, and they are converted into the product dimensional data (coil diameter (D) and pitch (P)) provided when the spring is formed, as described before. Accordingly, the bending positions and the twisting positions are set in response to the predetermined feeding amount, to form the working data map MP. In addition, calculated is the cycle of alternating diameters between a local maximum diameter and a local minimum diameter of the target helical spring, in response to which the bending positions are adjusted automatically. Then, on the basis of the bending positions and twisting positions as provided above, the bending and twisting processes are made to form the helical spring (not shown). According to the present embodiment, the temper-treatment (heat-treatment) is applied to the helical spring as the after-treatment, and then transferred outside. In addition to that, the setting process for applying the predetermined load to the spring may be made.

Figure 16:
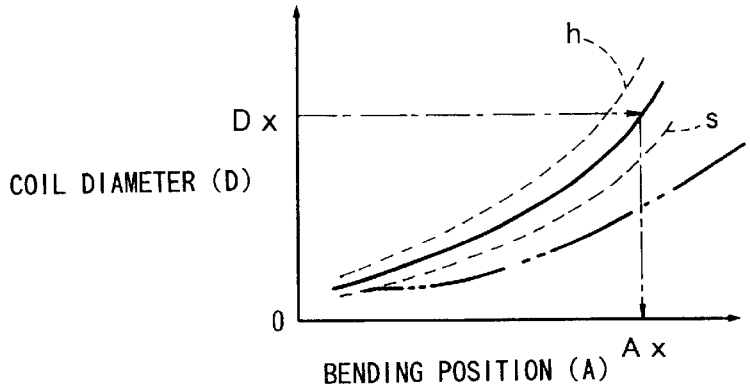
FIG. 16 is a diagram for use as a map for setting a bending position in response to a coil diameter according to another embodiment of the present invention.

According to the present embodiment, the adjusting device MK is constituted in the controller CT as shown in FIG. 3, as well as the parameter setting device MT, data converting device MD, working conditions setting device MC, correction device MH and the working data map MP as shown in FIG. 14. And, the coiling machine CM as shown in FIG. 14 is controlled according to the flowchart as shown in FIGS. 4 and 5, to perform the coiling operation in substantially the same manner as explained before with reference to FIG. 4, except for the process for adjusting the bending positions (A) in accordance with a characteristic as shown in FIG. 16. That is, the working conditions set at Step 104 in FIG. 4 are provided at Step 202 in FIG. 5, where the bending position (A) (or, moving amount (δA)) and the twisting position (B) (or, moving amount (δB)) are set as shown in FIG. 16 and FIG. 9, respectively. Furthermore, the bending position (A) (or, moving amount (δA)) is adjusted into the characteristic as indicated by a two-dotted chain line in FIG. 16, according to the present embodiment. And, the correcting process thereto as described before is made, if necessary, thereby to provide the data indicative of positions in accordance with the total wire feeding amount (L) (or, the wire feeding amount (δL)).

Figure 17:
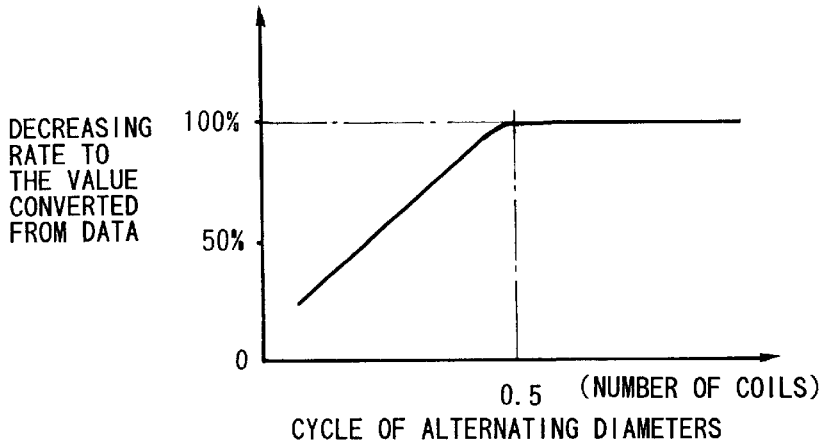
FIG. 17 is a diagram showing a reducing rate of the value converted from data set in response to the cycle of alternating diameters according to another embodiment of the present invention.

More particularly, the bending position (A) (i.e., the position of the coiling pin 3) is set in response to the product dimensional data converted at Step 103 in FIG. 4, in accordance with the characteristic indicated by a solid line in FIG. 16, and the bending position (A) is corrected automatically in response to the cycle of alternating diameters, as indicated by the two-dotted chain line in FIG. 16. FIG. 16 shows the relationship between the coil diameter (D) and the bending position (A), and corresponds to FIG. 7 for use in the former embodiment. As indicated by arrows of one-dotted chain line in FIG. 16, therefore, a certain bending position (Ax) can be set for a certain coil diameter (Dx). In this respect, if the cycle of alternating diameters is small, the coil diameter which is varied when the spring is formed, is likely to be less than the value converted by the data converting device MD as described before (hereinafter, referred to as the value converted from data). If the target helical spring is constituted as described above, therefore, in the case where the cycle of alternating diameters becomes less than approximately 0.5 coils, as indicated in FIG. 17 which shows a decreasing rate to the value converted from data in response to the cycle of alternating diameters, when the number of coils is reduced, the cycle of alternating diameters will be reduced linearly. This is resulted from the structure of the coiling machine CM as shown in FIG. 12, as will be described hereinafter.

Figure 21:
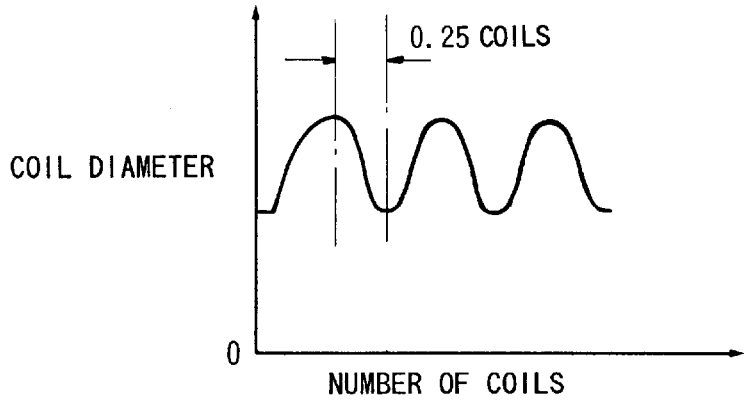
FIG. 21 is a diagram showing a relationship between the number of coils of the spring as shown in FIGS. 19 and 20 and the coil diameters thereof.
Figure 22:
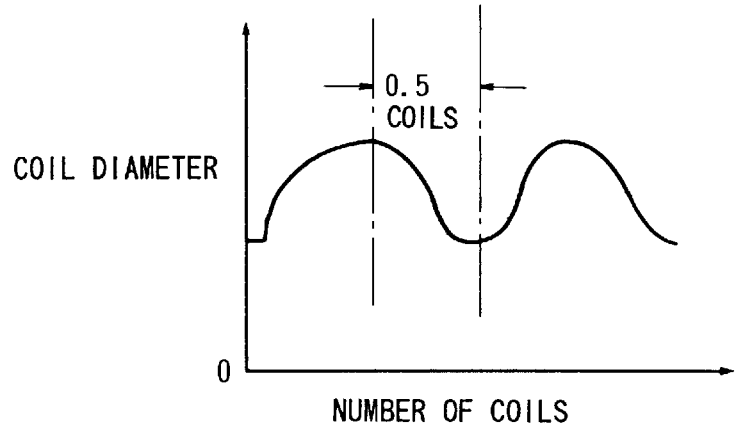
FIG. 22 is a diagram showing a relationship between the number of coils and coil diameters of a curved helical spring.
Figure 23:
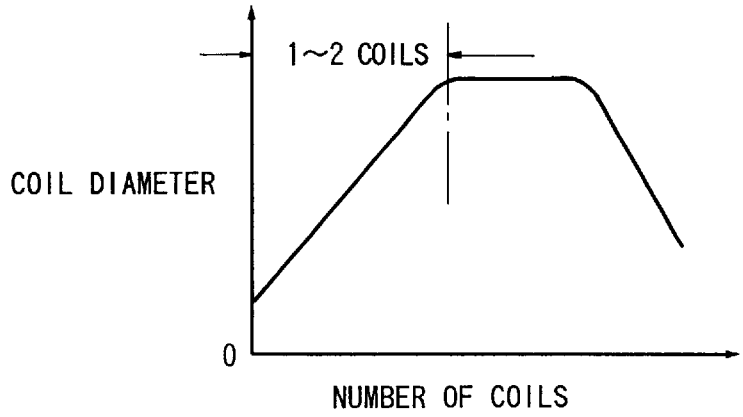
FIG. 23 is a diagram showing a relationship between the number of coils and coil diameters of an ordinary helical spring with opposite ends thereof formed into pigtails.

As shown in FIG. 12, it is necessary to feed at least approximately 0.4 coils from the start of bending the element wire to the end, the position of the element wire that is actually formed is "b" point, where 0.4 coils of the wire is advanced from "a" point, from which feeding the wire W is started. In other words, at least 0.4 coils of the element wire is needed to bend the wire W, so that some countermeasure will be needed when the portion of less than 0.5 coils, for example, is to be formed. If the spring is formed by using the value converted from data in that situation, there will be caused an error between the estimated value of the coil diameter and the value of the formed spring. For example, if a helical spring is to be disposed as shown in FIGS. 19 and 20, it is necessary to produce the deformed helical spring S1 with its upper portion formed into a shape having an oval cross section, so as to avoid contacting with barriers B1 and B2. In this case, as shown in FIG. 21, the cycle of alternating diameters (indicated by the number of coils between the local maximum diameter and the local minimum diameter of the helical spring) is approximately 0.25 coils, which is less than 0.5 coils, so that an error will be caused. Instead, if the helical spring is formed into the one having a circular cross section, it will be necessary to make its coil diameter as small as the spring will not contact with the barriers B1 and B2. In this case, however, the characteristic of the spring will be limited, so that it will be difficult to freely design the helical spring.

According to the present embodiment, therefore, the portion with the cycle of alternating diameters being less than 0.5 coils is to be formed by correcting the value converted from data (by multiplying the decreasing rate) in advance, in response to the decreasing rate which depends upon the cycle of alternating diameters, as shown in FIG. 17, and the bending positions will be corrected automatically, as described hereinafter. In the case where the cycle of alternating diameters is less than a predetermined value (e.g., 0.5 coils), an ordinary characteristic as indicated by the solid line in FIG. 16 is not used, but a characteristic as indicated by the two-dotted chain line in FIG. 16 is used for identifying the bending position (Ax). That is, the reducing rate is obtained in response to the cycle of alternating diameters, in accordance with the characteristic as shown in FIG. 17, and then the characteristic is changed from the one as indicated by the solid line in FIG. 16 to the one as indicated by the two-dotted chain line in FIG. 16, in response to the decreasing rate. Or, a map is changed from the one for the former characteristic to the one for the latter characteristic. Further, FIGS. 22 and 23 indicate the relationships between the number of coils and coil diameters, with respect to the curved helical spring and the helical spring with opposite ends thereof formed into pig tails, respectively. According to these springs, the cycle of alternating diameters is equal to or greater than 0.5 coils, so that no error will be caused, even if the value converted from the data is used for producing them.

Figure 18:
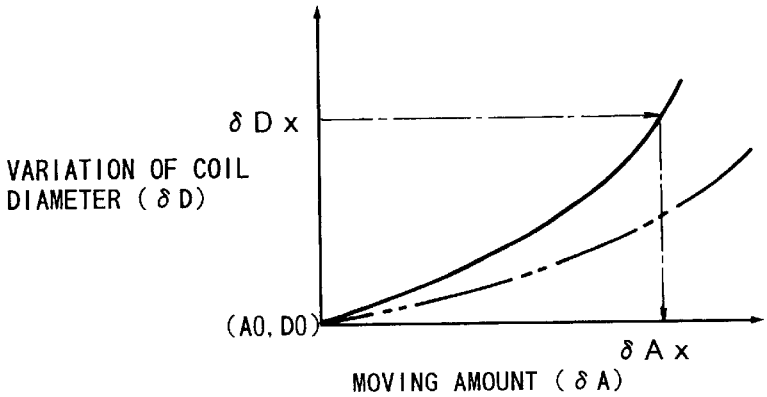
FIG. 18 is a diagram for use as a map for setting a moving amount in response to a variation of a coil diameter according to another embodiment of the present invention.

The characteristic as shown in FIG. 16 is varied in dependence upon the wire diameter (d). In accordance with variation of the wire diameter (d), therefore, it is appropriate to provide a plurality of maps, one of which may be properly selected in accordance with the wire diameter (d). Furthermore, when the adjustment is made in response to the cycle of alternating diameters, it is appropriate to provide a plurality of maps for target helical springs having various configurations, one of which may be properly selected in accordance with the cycle of alternating diameters. In FIG. 16, a broken line (h) indicates the characteristic for the wire of relatively hard material, while a broken line (s) indicates the characteristic for the wire of relatively soft material. Thus, the characteristic as shown in FIG. 16 is varied in dependence upon the material of the spring. Therefore, a plurality of maps may be provided in accordance with the material of the element wire. According to the present embodiment, however, an average characteristic is provided as a standard characteristic, and a correction thereto is made in response to hardness of the material, separately, at Step 205. According to the map as shown in FIG. 16, the data will become large. In order to avoid the large data, therefore, may be employed, a map as shown in FIG. 18, wherein a reference position is provided at a position having the coil diameter (DO) of the end coil to be coiled, and the bending position (AO) corresponding thereto, and wherein the relationship between a variation (δD) of the coil diameter from the reference position and the moving amount (δA) of the bending process (i.e., the moving amount of the coiling pin 3) is indicated. In this case, it is so constituted that the characteristic is changed from the one as indicated by the solid line in FIG. 18 to the one as indicated by the two-dotted chain line in FIG. 18, or a map is changed from the one for the former characteristic to the one for the latter characteristic.

With respect to the twisting position (B) (i.e., the position of the pitch tool 4) is set at Step 203 in accordance with the map as shown in FIG. 9, as well as the embodiment as described before. According to the present embodiment, the twisting position (Bx) may be adjusted in response to the cycle of alternating pitches (clearances between the neighboring wires), which corresponds to the cycle of alternating diameters used for the bending process. At Steps following Step 203, the present embodiment will be operated in substantially the same manner as described in FIG. 5. When the helical spring as disclosed in FIGS. 19 and 20 is formed according to the present embodiment, however, the bending position (Ax) is adapted to be adjusted, with respect to the portion with the cycle of alternating diameters less than 0.5 coils in the present embodiment, as described before.

Figure 24:
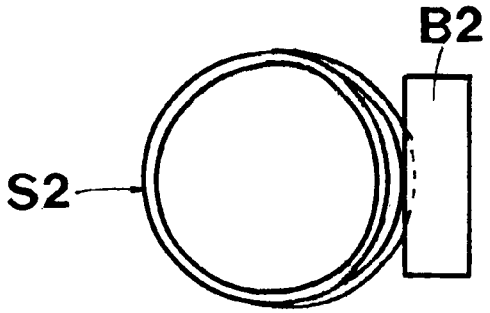
FIG. 24 is a plan view of a helical spring produced according to a further embodiment of the present invention.
Figure 25:
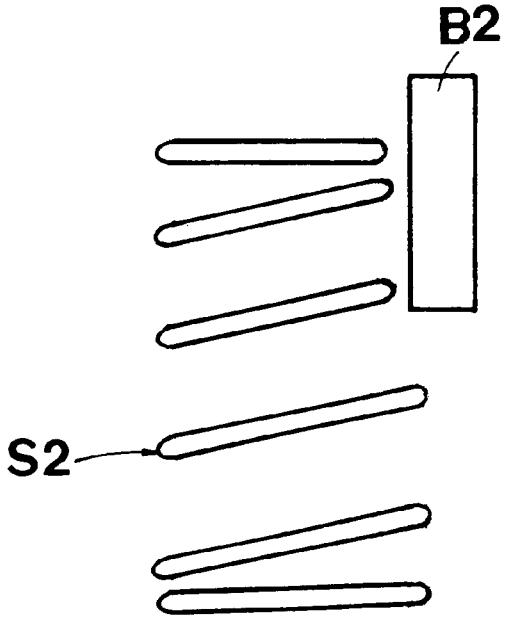
FIG. 25 is a front view of a helical spring produced according to a further embodiment of the present invention.

FIGS. 24 and 25 show a further embodiment of the helical spring which is produced according to the present invention. Since there exist a barrier B2 in this case, it is necessary to form a deformed helical spring S2 having an upper portion with a half part thereof formed into a half oval cross section. When the portion having the half oval cross section is formed, the decreasing rate is obtained in response to the cycle of alternating diameters, in accordance with the characteristic as shown in FIG. 17. In response to this decreasing rate, the characteristic is changed from the one as indicated by the solid line in FIG. 16 to the one as indicated by the two-dotted chain line in FIG. 16, or a map is changed from the one for the former characteristic to the one for the latter characteristic. Accordingly, the deformed helical spring S2 as shown in FIGS. 24 and 25 can be properly placed next to the barrier B2.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method for producing a helical spring by cold working to bend and twist an element wire while feeding the wire, comprising:

providing a plurality of parameters for defining a desired configuration of a target helical spring, the parameters including at least a radial dimension provided in a radial direction of each coil of the target helical spring;

setting at least bending positions and twisting positions for each coil of the target helical spring at least on the basis of the radial dimension in accordance with the configuration of the target helical spring; and bending and twisting the element wire at the positions set in response to every predetermined feeding amount of the element wire, to produce the target helical spring with each coil thereof formed to provide the radial dimension.

2. The method for producing the helical spring of claim 1, wherein the parameters comprise number of coils, coil diameter and lead of the target helical spring, and wherein the coil diameter of each coil serves as the radial dimension.

3. The method for producing the helical spring of claim 1, further comprising:

applying a predetermined after-treatment to the helical spring produced by bending and twisting the element wire; and correcting the bending positions and twisting positions set for each coil on the basis of the plurality of parameters, in accordance with the configuration of the helical spring with the after-treatment applied thereto.

4. The method for producing the helical spring of claim 3, wherein the after-treatment includes at least heat treatment, and wherein the bending positions and twisting positions set on the basis of the plurality of parameters are corrected in accordance with the configuration of the helical spring with the heat-treatment applied thereto.

5. The method for producing the helical spring of claim 3, wherein the parameters include number of coils, coil diameter and lead of the target helical spring, and wherein the coil diameter of each coil serves as the radial dimension.

6. A method for producing a helical spring by cold working to bend and twist an element wire while feeding the wire, comprising:

providing a plurality of parameters for defining a desired configuration of a target helical spring, the parameters including at least a radial dimension provided in a radial direction of each coil of the target helical spring;

setting at least bending positions and twisting positions for each coil of the target helical spring at least on the basis of the radial dimension in accordance with the configuration of the target helical spring;

adjusting at least the bending positions in response to the cycle of alternating diameters between a local maximum diameter and a local minimum diameter of the target helical spring; and bending and twisting the element wire at the positions set and adjusted in response to every predetermined feeding amount of the element wire, to produce the target helical spring with each coil thereof formed to provide the radial dimension.

7. The method for producing the helical spring of claim 6, wherein the parameters include number of coils, coil diameter and lead of the target helical spring, and wherein the coil diameter of each coil serves as the radial dimension.

8. The method for producing the helical spring of claim 6, further comprising:

applying a predetermined after-treatment to the helical spring produced by bending and twisting the element wire; and correcting the bending positions and twisting positions set for each coil on the basis of the plurality of parameters, in accordance with the configuration of the helical spring with the after-treatment applied thereto.

9. The method for producing the helical spring of claim 8, wherein the parameters include number of coils, coil diameter and lead of the target helical spring, and wherein the coil diameter of each coil serves as the radial dimension.

10. An apparatus for producing a helical spring by cold working to bend and twist an element wire while feeding the wire, comprising:

parameter setting means for providing a plurality of parameters for defining a configuration of a target helical spring, the parameters including at least a radial dimension provided in a radial direction of each coil of the target helical spring;

data converting means for converting the plurality of parameters provided by the parameter setting means into at least bending positions and twisting positions for each coil of the target helical spring at least on the basis of the radial dimension in accordance with the configuration of the target helical spring;

working conditions setting means for setting at least the bending positions and twisting positions in response to the result converted by the data converting means;

feeding means for feeding the element wire;

bending means for bending the element wire fed by the feeding means;

twisting means for twisting the element wire fed by the feeding means; and driving means for driving the feeding means, the bending means and the twisting means, the driving means placing the element wire at the positions set in response to every predetermined feeding amount of the element wire, on the basis of the bending positions and twisting positions set by the working conditions setting means, then bending and twisting the element wire to produce the target helical spring with each coil thereof formed to provide the radial dimension.

11. The apparatus for producing the helical spring of claim 10, wherein the working conditions setting means comprises:

feeding amount setting means for setting the feeding amount of the element wire fed from a predetermined reference position;

bending position setting means for setting the bending position in response to the feeding amount of the element wire set by the feeding amount setting means; and twisting position setting means for setting the twisting position in response to the feeding amount of the element wire set by the feeding amount setting means.

12. The apparatus for producing the helical spring of claim 10, wherein the parameter setting means provides the parameters including number of coils, coil diameter, and lead of the target helical spring, and wherein the coil diameter of each coil serves as the radial dimension.

13. The apparatus for producing the helical spring of claim 10, further comprising:

after-treatment means for applying a predetermined after-treatment to the helical spring produced by bending and twisting the element wire; and correction means for correcting the bending positions and twisting positions set for each coil on the basis of the plurality of parameters, in accordance with the configuration of the helical spring with the after-treatment applied thereto by the after-treatment means.

14. The apparatus for producing the helical spring of claim 13, wherein the after-treatment performs at least heat treatment, and wherein the correction means corrects the bending positions and twisting positions set for each coil on the basis of the plurality of parameters, in accordance with the configuration of the helical spring with the heat-treatment applied thereto.

15. The apparatus for producing the helical spring of claim 13, wherein the parameter setting means provides the parameters including number of coils, coil diameter and lead of the target helical spring, and wherein the coil diameter of each coil serves as the radial dimension.

16. The apparatus for producing the helical spring of claim 10, further comprising adjusting means for adjusting at least the bending positions in response to the cycle of alternating diameters between a local maximum diameter and a local minimum diameter of the target helical spring, wherein the working conditions setting means sets at least the bending positions and twisting positions in response to the result converted by the data converting means and the result adjusted by the adjusting means.

17. The apparatus for producing the helical spring of claim 16, wherein the parameter setting means provides the parameters including number of coils, coil diameter and lead of the target helical spring, and wherein the coil diameter of each coil serves as the radial dimension.

18. The apparatus for producing the helical spring of claim 16, wherein the working conditions setting means comprises:

feeding amount setting means for setting the feeding amount of the element wire fed from a predetermined reference position;

bending position setting means for setting the bending position in response to the feeding amount of the element wire set by the feeding amount setting means; and twisting position setting means for setting the twisting position in response to the feeding amount of the element wire set by the feeding amount setting means, and wherein the adjusting means controls the bending position setting means to adjust the bending position set by the bending position setting means.

19. The apparatus for producing the helical spring of claim 16, further comprising:

after-treatment means for applying a predetermined after-treatment to the helical spring produced by bending and twisting the element wire; and correction means for correcting the bending positions and twisting positions set for each coil on the basis of the plurality of parameters, in accordance with the configuration of the helical spring with the after-treatment applied thereto by the after-treatment means.

20. The apparatus for producing the helical spring of claim 19, wherein the parameter setting means provides the parameters including number of coils, coil diameter and lead of the target helical spring, and wherein the coil diameter of each coil serves as the radial dimension.

* * * * *